US010849415B2

(12) United States Patent
De Bardonneche

(10) Patent No.: US 10,849,415 B2
(45) Date of Patent: Dec. 1, 2020

(54) DEVICE FOR APPLYING A FLOWING OR PASTE-LIKE PRODUCT TO KERATIN FIBRES

(71) Applicant: MONTAIGU DEVELOPPEMENT, Chambourcy (FR)

(72) Inventor: Eric De Bardonneche, Courpalay (FR)

(73) Assignee: MONTAIGU DEVELOPMENT, Chambourcy (FR)

( * ) Notice: Subject to any disclaimer, the term of this patent is extended or adjusted under 35 U.S.C. 154(b) by 405 days.

(21) Appl. No.: 15/565,800

(22) PCT Filed: Apr. 12, 2016

(86) PCT No.: PCT/FR2016/050840
§ 371 (c)(1),
(2) Date: Oct. 11, 2017

(87) PCT Pub. No.: WO2016/166462
PCT Pub. Date: Oct. 20, 2016

(65) Prior Publication Data

US 2018/0116388 A1 May 3, 2018

(30) Foreign Application Priority Data

Apr. 14, 2015 (FR) ..... 15 53258

(51) Int. Cl.
*A46B 9/02* (2006.01)
*A46B 3/00* (2006.01)

(52) U.S. Cl.
CPC ..... *A46B 9/021* (2013.01); *A46B 3/005* (2013.01); *A46B 9/028* (2013.01); *A46B 2200/1053* (2013.01)

(58) Field of Classification Search
CPC ..... A46B 9/021; A46B 9/028; A46B 9/00; A46B 9/02; A46B 9/026; A46B 3/005;
(Continued)

(56) References Cited

U.S. PATENT DOCUMENTS 6,412,496 B1 * 7/2002 Gueret ..... A45D 40/267 132/218
6,539,950 B1 4/2003 Gueret
(Continued)

FOREIGN PATENT DOCUMENTS

EP 1070465 A2 1/2001
FR 3004905 A1 10/2014
(Continued)

OTHER PUBLICATIONS

International Search Report of PCT/FR2016/050840 dated Jun. 30, 2016.
(Continued)

*Primary Examiner* — Nicholas D Lucchesi
(74) *Attorney, Agent, or Firm* — Amster, Rothstein & Ebenstein LLP

(57) ABSTRACT

The present invention relates to an device for applying a flowing or paste-like product to keratin fibers, comprising an elongate central core (1) extending along a longitudinal axis XX, at least one row of elongate bristles (2) comprising a first end (20) embedded on the core and a second, free end (21), the bristles (2) and the core (1) being made in one piece. According to the invention, at least one of bristles has a flattened shape in a plane substantially perpendicular to axis XX, said at least one bristle being defined in a front view by a first ridge (25) that is continuously convex or concave from the base (20) thereof embedded in the core (1) up to the second end (21), and by a second ridge (26) consecutively concave and convex from the base (20) thereof embedded in the core up to the second end (21), the first and second ridges meeting at the free end (21). The bristles have a slit (24) in the body thereof for defining a first (22) and a second (23) side flank arranged opposite one another. Two bristles consecutively rooted along the length
(Continued)

of the applicator may form at least one distal opening (30) between one another.

9 Claims, 6 Drawing Sheets

(58) Field of Classification Search
CPC .... A46B 2200/1053; A46B 2200/1046; A46B 2200/106; A46B 1/00; A45D 34/045; A45D 34/042; A45D 40/265; A45D 40/26; A45D 40/262; A46D 1/0238; A46D 1/0246; A46D 1/0253; A46D 1/02
USPC ..... 132/218, 216, 320; D4/127, 128, 133; 15/207.2, DIG. 5, 186, 187; D28/10
See application file for complete search history.

(56) References Cited

U.S. PATENT DOCUMENTS 6,581,610 B1 * 6/2003 Gueret ..... A45D 40/267 132/218
10,299,565 B2 * 5/2019 Sanchez ..... A45D 40/265
2007/0062551 A1 * 3/2007 De Brouwer ..... A45D 34/045 132/218
2012/0192892 A1 * 8/2012 Kulik ..... A46B 9/021 132/218
2014/0056636 A1 2/2014 Gueret
2016/0073767 A1 * 3/2016 Sanchez ..... A46B 9/021 401/129

FOREIGN PATENT DOCUMENTS

JP 2001-145515 A 5/2001
WO WO 2011/045770 * 10/2010 ..... A45D 40/26
WO 2014/195914 A1 12/2014

OTHER PUBLICATIONS

Notice of Reasons for Refusal dated Jun. 4, 2020 in connection with Japanese Patent Application No. 2017-554254.

* cited by examiner

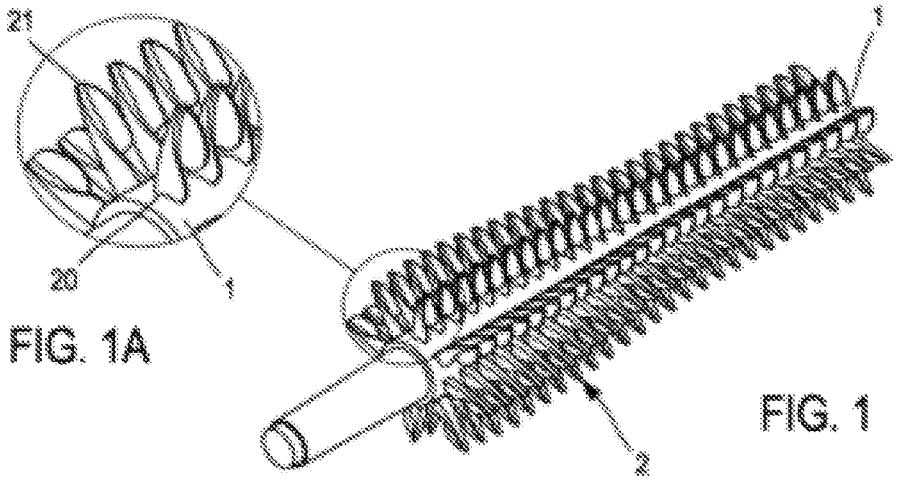
FIG. 1A
FIG. 1
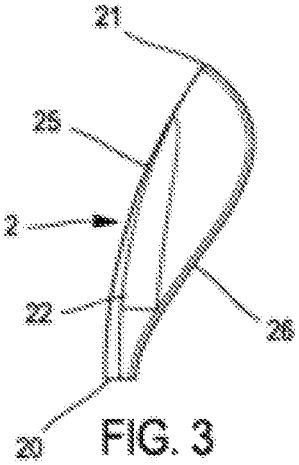
FIG. 3
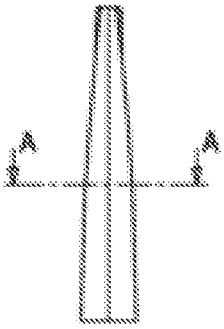
FIG. 2
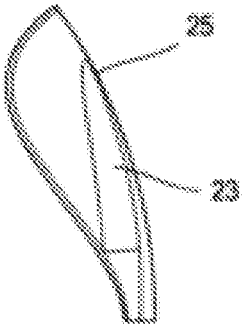
FIG. 4
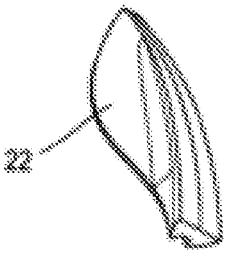
FIG. 5
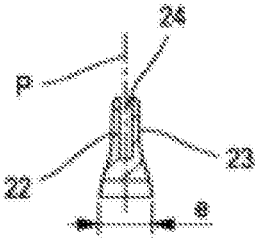
FIG. 2A
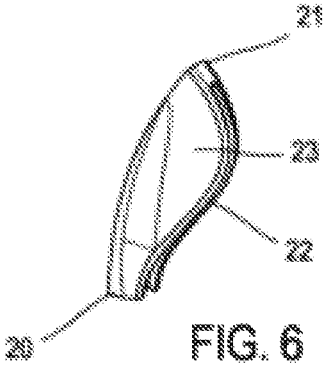
FIG. 6

COUPE B-B

DEVICE FOR APPLYING A FLOWING OR PASTE-LIKE PRODUCT TO KERATIN FIBRES

TECHNICAL FIELD OF THE INVENTION

The invention relates to the field of applicators for a fluid or viscous cosmetic product of the mascara type. The invention relates more specifically to the device or means for applying cosmetic product.

PRIOR ART

Very many mascara applicators are already known in the prior art. The application device in itself may for example be an elongate-shaped brush provided with a central core from which a set of hairs or bristles stick out. The bristles relate to an old technology: a twisted metal wire holds bristles that stick out transversely. An example of an application is illustrated in the American patent U.S. Pat. No. 5,611,361.

More recently, the application device is in the form of a brush comprising a series of bristles embedded on the longitudinal core of the brush. The whole is moulded from plastics material. An application device thus forms, with a suitable reservoir in which it can be inserted, a cosmetic-product distributor. The applications FR 2 810 860 and WO 2011/045770 show a few examples of applicators resulting from this concept.

The drawbacks of the application devices, or brushes, of the prior art are that the bristles do not make it possible to correctly effect a transfer of the cosmetic product from the reservoir onto the bristles, and a suitable application of the product to the keratin fibres, in order to extend, thicken and/or separate them.

One solution envisaged by the prior art TO improv the loading of the brushes with mascara consists of using bristles having a flat face to collect the mascara while the non-flat face participates in the separation of the eyelashes. The document EP 1 872 682 describes such a brush; the bristles are disposed in rows parallel to the longitudinal axis of the brush and all the bristles in a row have their flat face on the same side: the flat faces are aligned while the non-flat faces are situated on the same side of the line. The user of the brush therefore imparts a movement of the brush in a direction perpendicular to the longitudinal axis of the brush, while turning the latter.

The brushes of this type do not have maximum efficiency since the flat faces do not participate in the separation of the eyelashes and the non-flat faces do not participate in the loading with mascara. With this type of brush, the user is therefore forced to make several passes over the eyelashes while reversing the movement of the brush in order to ensure that a sufficient load of mascara is recovered.

Somewhat differently, the patent application EP 1 611 817 discloses a device for applying mascara comprising a longitudinal support, and first and second rows of bristles produced in a single piece with the support, embedded on the same side of the support and extending over more than a quarter of the length of the support. The teeth (or bristles) extend on either side of a so-called separation geometric surface formed according to two non-parallel directions and surfaces. The bristles are erected from a flat face of the support, and are provided so as to be staggered on either side of the separation surface. Thus, when mascara is applied, the to and from movement imparted to the brush does not provide an optimum distribution of the load or suitable separation of the eyelashes.

The patent application FR 2 930 875 is also known, which describes a device for applying cosmetic product comprising a longitudinal core supporting several rows of bristles having a flat face and projected radially from the core. The bristles are distributed in at least one row parallel to the longitudinal axis of the core so that, on the same row, the bristles are positioned alternately on either side of a central line (or plane) of the row, with their flat face turned towards the inside of the row. According to one feature of the invention, the flat faces of the bristles in the same row extend perpendicular to the core and are aligned, and are oriented in both gyratory directions around the core.

Even though this solution affords a certain improvement vis-à-vis the prior art, the modularity of the load is not obtained favourably. Furthermore the separation of the eyelashes remains open to improvement.

The prior art moreover comprises the patent application EP 1 070 465 A2, which describes a comb the teeth of which are distributed in two rows of tapered curved teeth, symmetrically vis-à-vis a separation geometric surface. This improvement offers a certain modularity in the holding of the cosmetic product but finds an advantage in the application to a comb or any equivalent device.

The patent application FR 3 004 905 A1 describes a device for applying cosmetic product to eyelashes or eyebrows, the bristles of which may have a sophisticated profile in side view; however, the geometry of these bristles does not allow a significant retention of cosmetic product.

The patent application FR 2 937 514 is also known, which describes a mascara applicator the bristles of which, obtained by moulding with the core, are distributed in rows parallel to the longitudinal axis of the core and extend so as to project in curvature from the core. The general curvature of the bristles is substantially circular so that, according to one of the embodiments, an applicator in the form of brushes with curved bristles; such an applicator makes it possible to curve the eyelashes but the load deposited is constant and small.

A development therefore appears necessary in particular with regard to the shape of each bristle. Each bristle must contribute to improving, alone or in combination with other bristles, both the product load and the separation of the eyelashes or keratin fibres.

DISCLOSURE OF THE INVENTION

The invention aims to remedy the drawbacks of the prior art and in particular to propose an application device able to capture a maximum volume of cosmetic product when it is in contact therewith, while keeping this product even after the pass or passes over the wiper; the wiper is a small part disposed on the opening of the container, able to remove the surplus cosmetic product captured by the applicator itself.

To do this, a device for applying a product of fluid or past-like type to keratin fibres is proposed, comprising an elongate shaped central core that extends along a longitudinal axis XX, and at least one row of elongate bristles comprising a first end embedded on the core and a second free end, the bristles and the core being formed, or more precisely being moulded, in a single piece.

According to a first aspect of the invention, at least one of the bristles has a flattened shape in a plane substantially perpendicular to the axis XX, said at least one bristle being defined in front view by a first ridge continuously convex or concave from its base embedded in the core to the second free end, and by a second ridge having at least two curvatures separated by a change of direction from its base embedded in the core to the second free end of the bristle, the first and second ridges joining at the free end.

According to a preferred embodiment of the invention, said bristles have a slot in their thickness able to define first and second lateral flanks disposed facing each other.

These characteristic features of the invention allow good retention of the cosmetic product by a reservoir effect in the bristle itself; here the wettability, that is to say the capture of the cosmetic product at the bristle itself, is increased. Thus, for a given number of bristles, the retention of cosmetic product is improved; this constitutes an interesting advantage of the invention. Moreover, it is thus possible to regulate the volume of cosmetic product that can be captured very finely and precisely since it is to the scale of the bristle.

In addition, having regard to the general shape of the bristle, the volume of product retained is different between the root and the free end of the bristle: more product is retained close to the free end, where the eyelashes are in almost certain contact with the bristles.

Furthermore, the characteristic shape of the bristles allows maximum flexion when passing over the wiper while retaining a maximum volume of cosmetic product. It is a case advantageously of capturing a maximum volume of cosmetic product by virtue of the specific shape of the bristles, keeping this volume when passing over the wiper, and then restoring the volume once outside the product. The brush according to the invention acts as a sponge that absorbs or captures product and then restores it when the eyelashes are in contact with the bristles.

"Front view" means the view from one end of the elongate core.

According to another feature of the invention, said slot is provided over the entire height of the bristle concerned. Height means the largest dimension of the bristle, which corresponds substantially to a radial dimension of the applicator.

More precisely, the first and second flanks have more than 5% of their surfaces facing each other. It is meant here that the flanks, which are disposed facing each other, separated by the slot, have facing surfaces that represent more than 5% of the substantially flat surface of one of the flanks.

According to one of the embodiments of the invention, one of said first or second flanks has in front view a cutout (opening) substantially in the form of a semicircle, the diameter of which corresponds substantially to a part of said second ridge.

According to another embodiment of the invention, the first and second flanks have a cutout (opening) defined from the second ridge and placed at a different height of the bristle.

Preferentially, the centroid of said opening is situated at between one tenth and nine tenths of the total height H of the bristle measured over a direction radial to the axis XX. This feature means that said opening can be provided at a variable height on the bristle, defined by a person skilled in the art according to the particular application.

According to an advantageous embodiment of the invention, the bristles are disposed in rows oriented along the longitudinal axis XX of the application device.

By way of illustration, the shape and/or arrangement of two bristles successively implanted on the axis XX is able to create at least one distal opening between them.

Furthermore, at least one of the bristles comprises at least one protrusion issuing from a bulge and/or a convexity.

According to the invention, said bristles form together a substantially cylindrical external shape (or envelope).

BRIEF DESCRIPTION OF THE FIGURES

Other features, details and advantages of the invention will emerge from a reading of the following description, with reference to the accompanying figures, which illustrate;

FIG. 1, a perspective view of the applicator device according to a first embodiment of the invention;

FIG. 1A, an enlarged view of a set of bristles disposed in a proximal zone of the application device;

FIG. 2, a side view, along the thickness, of a bristle;

FIG. 2A, a cross section along AA in FIG. 2;

FIG. 3, a front view of a bristle according to a first embodiment of the invention, showing a first lateral flank;

FIG. 4, a view of the other face of a bristle according to the first embodiment of the invention, showing a second lateral flank;

FIG. 5, a first perspective of a bristle according to the invention, seen from its embedding on the core, in relation to the first embodiment;

FIG. 6, a second perspective of a bristle according to a first embodiment of the invention;

For more clarity, the identical or similar elements are marked by identical reference signs in all the figures.

DETAILED DESCRIPTION OF AN EMBODIMENT

Figure 7A:
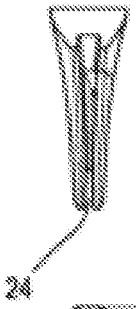
FIG. 7A, a view from below of a bristle according to a second embodiment of the invention.
Figure 8:
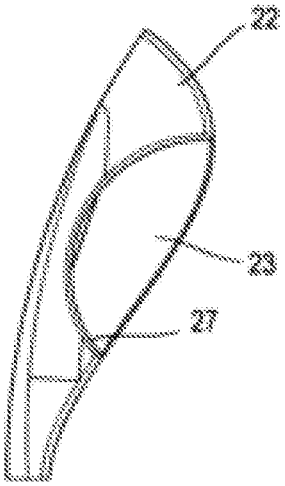
FIG. 8, a front view of a bristle according to the second embodiment of the invention showing a first lateral flank.
Figure 7:
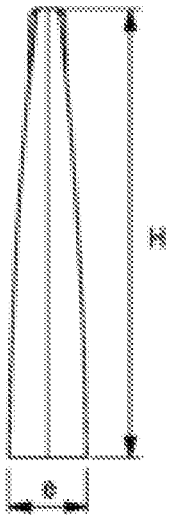
FIG. 7, a side view, along the thickness, of a bristle.
Figure 9:
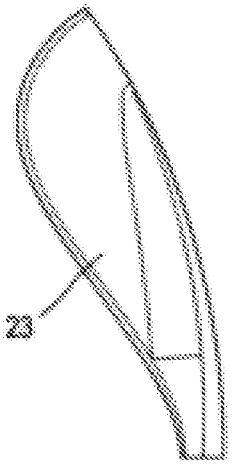
FIG. 9, a view of the other face of a bristle according to the second embodiment of the invention, showing a second lateral flank.

FIG. 1 shows a perspective of a device for applying cosmetic product, in particular mascara; this applicator comprises an elongate shaped central core 1 that extends along an axis XX. The cross section of the core 1 may be constant or not over the length thereof; it may be circular, oval, polygonal or other. From the core 1, a set of elongate bristles 2 or positive reliefs are erected. According to a preferred embodiment, the core 1 and the bristles 2 are moulded together. The bristles 2 preferentially extend substantially radially around the core 1 and are disposed in rows parallel to the longitudinal axis XX, although this arrangement is in no way limitative. FIG. 1A shows in more detail the implantation of the bristles 2 on the core 1, an implantation of the embedding type. The bristles are therefore embedded on the core at their base 20, while their second end 21 is free. The bristles are therefore flexible; the flexibility thereof is determined by several parameters, including in particular their size, their shape and their material.

The present invention proposes an advantageous and characteristic shape of the bristles 2, in several embodiments.

The bristles 2 have a flattened shape in a plane that is generally substantially perpendicular to the longitudinal axis XX. "Flattened" means that the bristles have a dimension along an axis of the trihedron that is appreciably less that the other two. Thus FIG. 2 and the cross section 2A show a bristle in its thickness e, of around 1 mm; FIGS. 3 and 4 show the same bristle, to the same scale, in front view, and it can be seen clearly that the dimensions are several times greater. The height H of this bristle may be 1 mm.

In front view, that is to say from the end of the applicator, the bristle is defined by a first ridge 25 that is continuously convex from the base 20 of the bristle as far as its free end 21. The first ridge corresponds favourably to a portion of a circle. Furthermore, the bristle 2 comprises a second ridge 26 successively concave and convex from the base 20 of the bristle as far as its end 21. The first ridge 25 and the second ridge 26 join at the free end 21. FIGS. 3 and 4 illustrate this characteristic shape. Furthermore, the bristles have a slot 24 situated at their thickness e so as to define two flanks, themselves flattened. The cross section AA shows clearly the slot 24 that delimits the two flanks 22, 23 in the thickness e of the bristle. It will be noted that the thickness e is here not constant: it is large at the base of the two flanks and smaller at the end of the flanks. A person skilled in the art is able to finely define these dimensions. The two flanks 22, 23 are referred to as lateral flanks in the remainder of this text. They have good flexibility, in particular close to their convex ridge 26 and/or the free end 21. The slot 24 therefore constitutes a space in which the cosmetic product is retained; the volume of product actually retained varies according the pressure exerted on the lateral flanks 22, 23, as will be explained below.

FIG. 5 shows, by means of a perspective view from the embedding 20 of the bristle, the characteristic shape thereof, according to a first embodiment of the invention. The first flank 22 can be seen more precisely therein. FIG. 6 shows more particularly the second flank 23, which has here a shape similar to the first flank. Symmetry along a plane P is therefore provided in this embodiment of the invention. Thus the first and second flanks have here 100% of their respective internal surfaces facing each other.

With regard to the total height H of the bristle 2, the height of the slot 24, that is to say its largest dimension, measured substantially along a radius of the applicator device, corresponds to the total height H of the bristle. Without departing from the scope of the invention, the height of the slot 24 could be less than the total height H of the slot.

Figure 10:
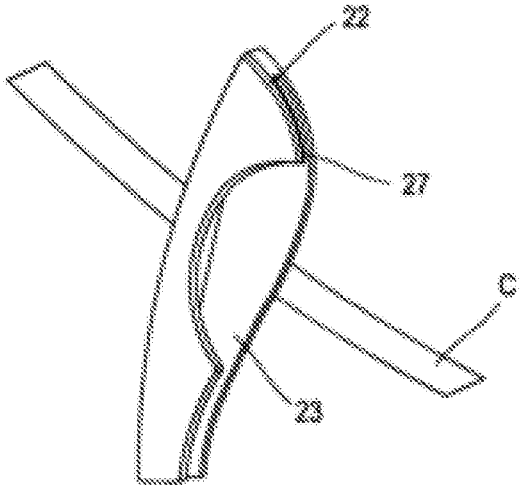
FIG. 10, a perspective view of a bristle, substantially from the side.

FIGS. 7 to 10 illustrate a second embodiment of the invention that differs from the first through the form of one of the lateral flanks 22 or 23. The first 22 or second 23 flank has here a cutout 27 substantially in the form of a semicircle, the diameter of which corresponds substantially to a part of the second ridge 26 of the bristle. The cutout 27 therefore issues from the second ridge 26 of the bristle; its form is substantially semicircular, but any similar form falls within the scope of the invention. The volume of product enclosed in the slot 24 is less great than in the first embodiment of the invention, but the bristle is more flexible, which may be advantageous. In addition the eyelash C, as shown in FIG. 10, is directly in contact with the surface corresponding to cutout 27 so that it is more easily loaded with product at this level; this constitutes an advantageous feature of the invention.

According to the second embodiment of the invention, the first 22 and second 23 flanks have approximately 50% of their solid surfaces facing each other.

Figure 12:
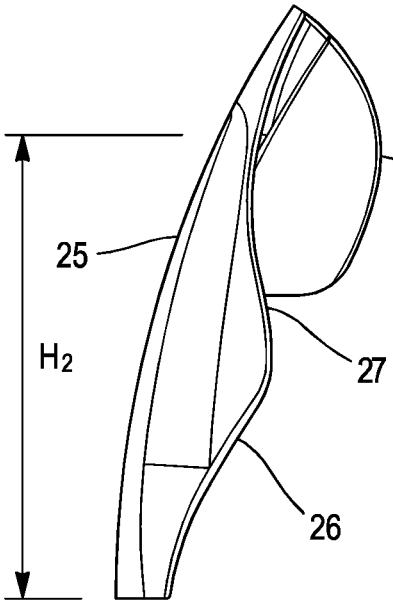
FIG. 12, a front view of a bristle according to the third embodiment of the invention, showing a first lateral flank.
Figure 11:
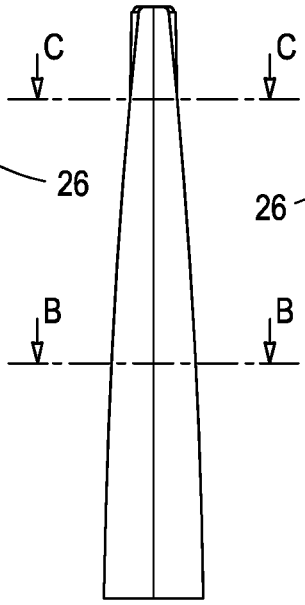
FIG. 11, a side view, along the thickness, of a bristle according to a third embodiment of the invention.
Figure 13:
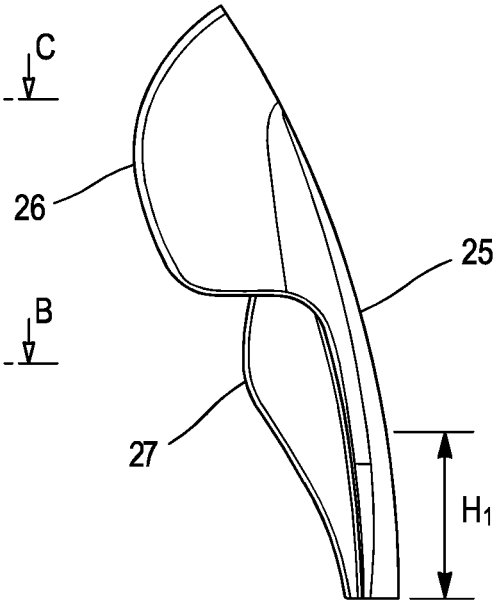
FIG. 13, a view of the other face of a bristle according to the third embodiment of the invention, showing a second lateral flank.
Figure 11B:
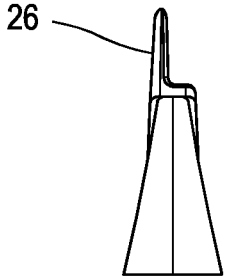
FIG. 11B, a plan view of the bristle of FIG. 11.
Figure 11A:
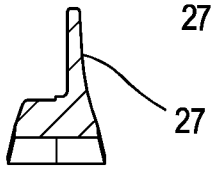
FIG. 11A, a cross section of the bristle according to FIG. 11 along BB.

FIGS. 11 to 13 illustrate a third embodiment of the invention according to which each flank 22, 23 has a cutout. More precisely, and as can be seen in particular in FIGS. 12, 13 and 14, the cutout 27 is defined from a second ridge 26. The cutout 27 on one of the flanks is placed at a height H1 while the cutout provided on the other flank is situated at a height H2 different from the height H1. The height H1 or H2 of the cutout may be defined as the difference between the embedding of the bristle on the core and the centroid of this cutout, a distance measured radially to the longitudinal axis XX. This embodiment of the invention allows a greater loading with cosmetic product since the eyelash comes into contact with the cosmetic product present on the internal face of the bristle 2 on both of its flattened faces. In comparison, the embodiment in FIGS. 7 to 10 allows loading via one of the faces of the bristle.

In general terms, the centroid of the cutout 27 is situated between one tenth and nine tenths of the total height H of the bristle, measured in a direction radial to the axis XX.

Figure 14:
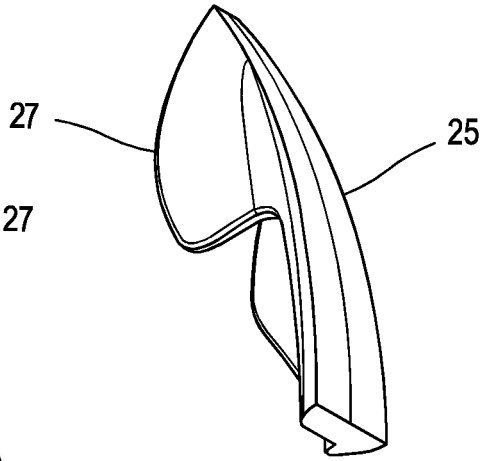
FIG. 14, a perspective view from below of the bristle according to the third embodiment of the invention.

FIG. 14 illustrates, by a perspective view from the embedding zone of the bristle, a bristle according the third embodiment of the invention.

By way of illustration, the applicator may have a length of between A mm and B mm; the bristles have a height of between C mm and D mm; the thickness e of the bristles is around E mm; the width or third dimension of the bristles may be between F mm and G mm.

Preferentially, the first ridges 25 of the bristles are all oriented in the same direction, facing, as illustrated by FIG. 1A.

Figure 15:
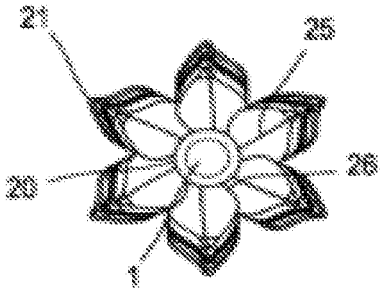
FIGS. 15, 16 and 17 relate respectively to a front view of the device according to a fourth embodiment of the invention, side and front views of the bristles, and a view in perspective of the second device.
Figure 16:
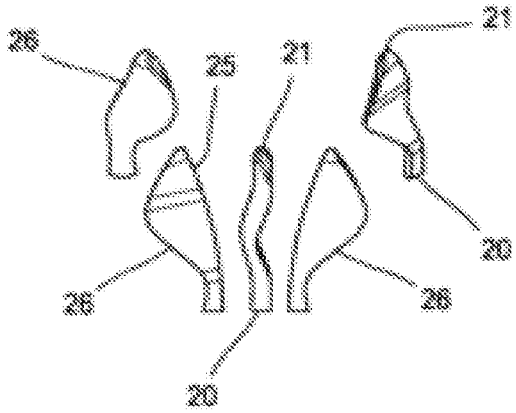

FIG. 15 illustrates a device in front view of a fourth embodiment of the invention; bristles 2 can be seen aligned along the length of the device. The bristles each have a first curved ridge 25 and a second ridge 26 successively convex and then concave, from a first embedded end 20 as far as their second free end 21. A slight overlap at the bases 20 of the bristles is made possible by the angular offset between two successive bristles over the length of the device. FIG. 16 specifies the form of the bristles, in space; these bristles, while being flattened, that is to say with a small dimension in a side view, do however have a slight curvature visible on the side view. A relief is thus created, assisting the capture of cosmetic product.

Figure 17:
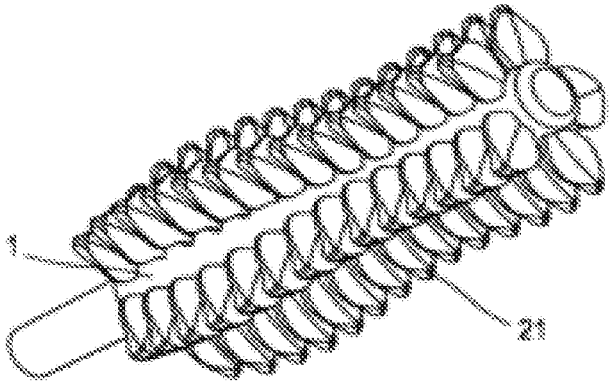

FIG. 17 shows, by a general perspective view, the implantation of the bristles, organised in rows, with a slight offset along the length, allowing the offset of the bases 20 visible in FIG. 15.

Figure 18:
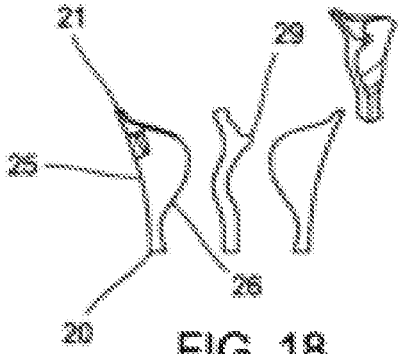
FIG. 18 illustrates bristles according to the fourth embodiment of the invention, provided with a lug.

FIG. 18 shows various views of bristles, which differ from those shown in FIG. 16 through the additional presence of lugs 29 oriented along their thickness. The lug 29 increases the surface area of capture of cosmetic product, and improves the contact with the eyelashes. Although the geometry of these lugs is more sophisticated than the previous ones, manufacture thereof by moulding is still possible.

Figure 19:
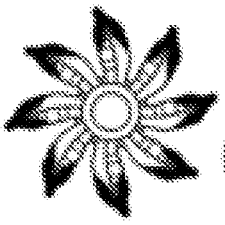
FIG. 19 is a front view of a fifth embodiment of the invention.
Figure 20:
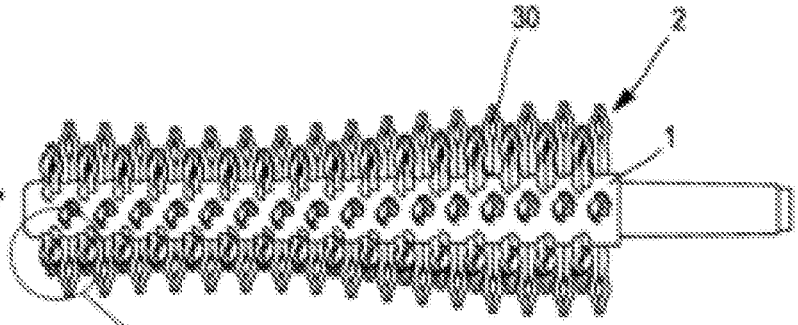
FIG. 20 is a side view of the embodiment in FIG. 19.
Figure 20A:
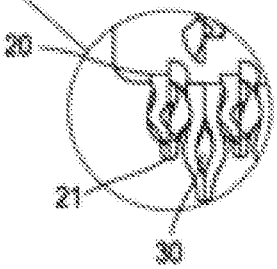
FIG. 20A is an enlarged view of the arrangement of the bristles on the device of FIGS. 19 and 20.

FIGS. 19, 20 and 20A illustrate an embodiment where the bristles are aligned over the length of the device, with bristles the first ridge 25 of which is curved in the same direction of curvature in front view. The bristles 2 are grouped in pairs in order to form, in front view, a kind of curved petals, characteristic of the invention. In side view and as can be seen more precisely in FIGS. 20 and 20A, the bristles have a curvature such that two longitudinally juxtaposed bristles form together a loop 30. Such a loop 30 represents a reservoir of cosmetic product, moreover flexible because of the dimensions and shapes envisaged. This aspect corresponds perfectly to the objective of the invention: sponge effect, able to capture a maximum amount of product, to trap it when passing through the wiper, and then to restore it at the time of contact with the eyelashes.

Figure 22:
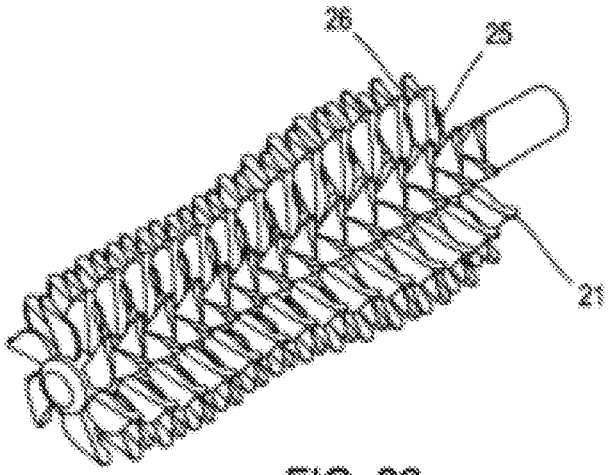
FIG. 22 is a perspective of the device according to the sixth embodiment of the invention.
Figure 21:
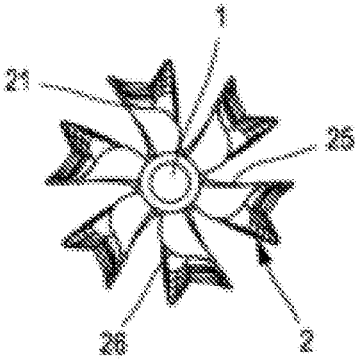
FIG. 21 is a front view of a sixth embodiment of the invention.

FIGS. 21 and 22 illustrate an embodiment similar to that of FIG. 15 but which differs therefrom through the implantation of the bristles 2 on the core 1: the alignments of bristles 2 (along the longitudinal axis XX) consist of an alternation of bristles, the first ridge 25 of which is curved in one direction and then in the other, with the same curvature. These alignments are more especially visible in FIG. 21; FIG. 22 illustrates the same alignments, in perspective.

Figures 23, 24, 25:
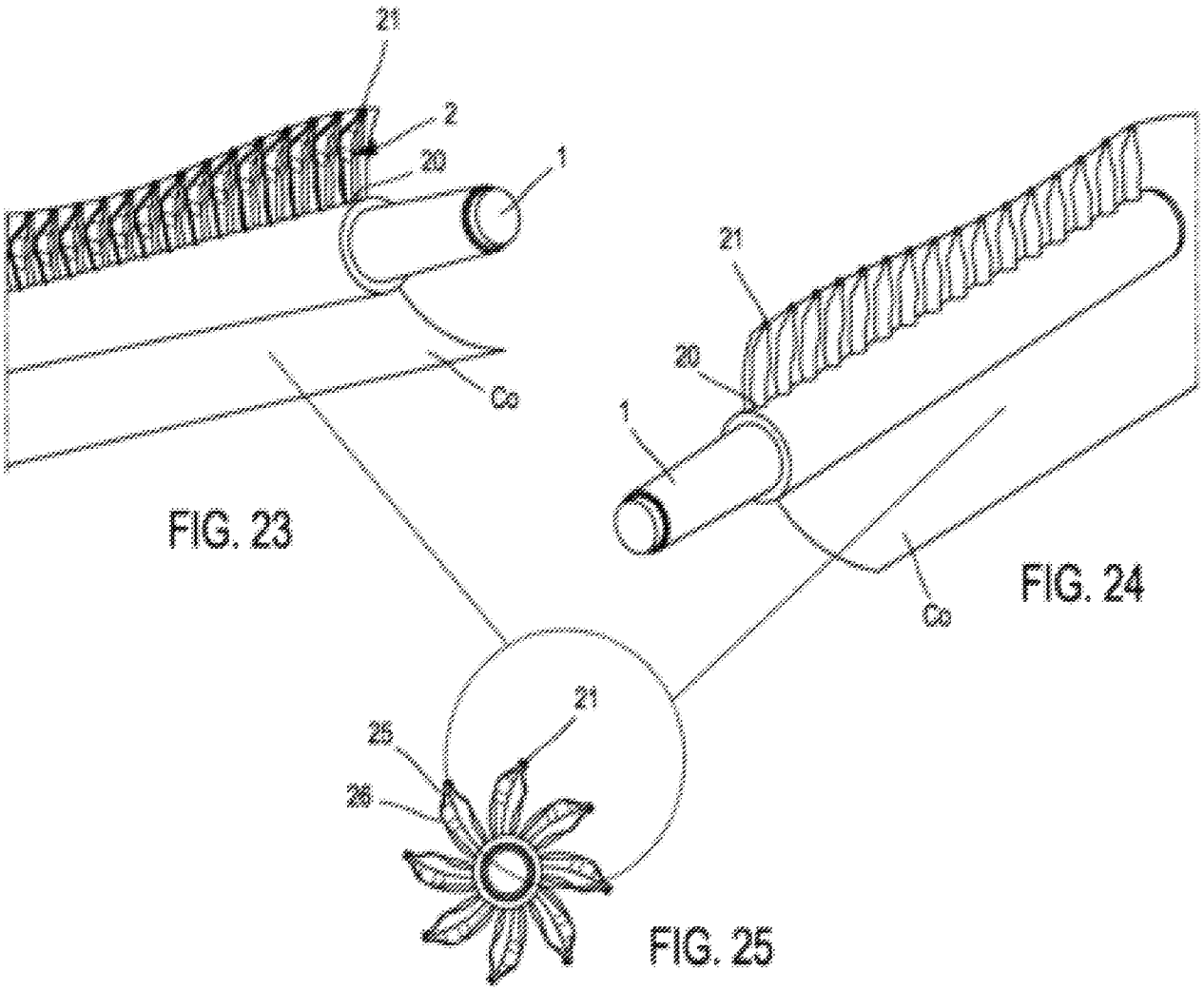
FIGS. 23 and 24 are diagrams for displaying in particular the curvature plane carrying the first ridges of the bristles.
FIG. 25 is a front view highlighting one of the features of the invention.

FIGS. 23 to 25 emphasise the continuous curvature Co of the first ridge 25 of the bristles. The circle associated with the front view in FIG. 25 clearly marks a curvature in which the first ridge 25 of the bristles fits. In FIG. 24, the bristles are not shown precisely but it is important to see the circle Co on which the first ridges 25 of the bristles bear.

Highly advantageously, the profile of the bristles 2 allows specific wiping and a restoration of the load of cosmetic product Naturally, other modifications of the invention can be made by a person skilled in the art without departing from the scope of the invention.

The invention claimed is:

1. A device for applying a product of fluid or past-like type to keratin fibres, comprising an elongate shaped central core that extends along a longitudinal axis (XX), at least one row of elongate bristles, each of the elongate bristles comprising a first end situated on the elongate shaped central core and a second free end, the elongate bristles and the elongate shaped central core being integral with each other in order to form a single piece, characterised in that at least one of the elongate bristles has a flattened shape in a plane perpendicular to the longitudinal axis (XX), said at least one of the elongate bristles being defined in the perpendicular plane by a first ridge continuously convex or concave curvature from the first end to the second free end, wherein the curvature bears on a circle that intersects the longitudinal axis in the perpendicular plane, and by a second ridge having at least two curvatures separated by a point of inflection from the first end to the second free end, the first and second ridges joining at the second free end, and in that said bristles have a slot in their thickness able to define first and second lateral flanks disposed facing each other.

2. A device according to claim 1, characterised in that said slot is provided over an entire height of the bristle concerned.

3. A device according to claim 1, characterised in that the first and second lateral flanks overlap with each other more than 5% according to the perpendicular plane.

4. A device according to claim 1, characterised in that said first or second lateral flanks have in the perpendicular plane a first cutout in the form of a semicircle, the diameter of which corresponds to a part of said second ridge.

5. A device according to claim 4, characterised in that the centroid of said first cutout is situated between one tenth and nine tenths of a total height al) of the bristle measured over a direction radial to the longitudinal axis (XX).

6. A device according to claim 1, characterised in that the first and second lateral flanks each have a second cutout defined from the second ridge and placed at a different height of the bristle.

7. A device according to claim 1, characterised in that the shape and/or arrangement of two adjacent elongate bristles of said at least one row of elongate bristles is able to create at least one distal opening between them.

8. A device according to claim 1, characterised in that at least one of the elongate bristles comprises at least one protrusion issuing from a bulge and/or from a convexity.

9. A device according to claim 1, characterised in that all of said elongate bristles have dimensions and/or orientations able to create a cylindrical external shape.

* * * * *